United States Patent [19]

Burke

[11] Patent Number: 4,916,428

[45] Date of Patent: Apr. 10, 1990

[54] HIGH VOLTAGE, OUTDOOR, AIR COOLED, DYNAMIC BRAKING RESISTORS AND POWER DISTRIBUTION SYSTEM INCORPORATING THE SAME

[75] Inventor: Patrick E. Burke, North York, Canada

[73] Assignee: 501 Guthrie Canadian Investments Limited, Scarborough, Canada

[21] Appl. No.: 286,161

[22] Filed: Dec. 19, 1988

[30] Foreign Application Priority Data

Sep. 9, 1986 [CA] Canada ..... 517838

[51] Int. Cl.[4] ..... H01C 3/02

[52] U.S. Cl. ..... 338/62

[58] Field of Search ..... 338/62, 296, 297, 260, 338/261, 267

[56] References Cited

U.S. PATENT DOCUMENTS 2,838,639 6/1958 Planer et al. ..... 338/62

3,164,797 1/1965 Ramrath ..... 338/62

3,560,905 2/1971 Rietz et al. ..... 338/62

*Primary Examiner*—Bruce A. Reynolds

*Assistant Examiner*—M. M. Lateef

*Attorney, Agent, or Firm*—Stanley E. Johnson

[57] ABSTRACT

An electrical resistor having first and second cylindrical resistance windings helically wound closely adjacent one another about a common axis and wound in opposite directions about such axis. The helical windings of the resistor are connected in parallel and the resistor is provided with terminals for placing it in series with a circuit to provide a resistance in such circuit. The resistors are used in a power distribution system that includes a first system connected to a second system by a tie line. The resistors referred to as braking resistors are located adjacent at least one of the power sources and are connected to the tie line through one or more circuit breakers.

7 Claims, 1 Drawing Sheet

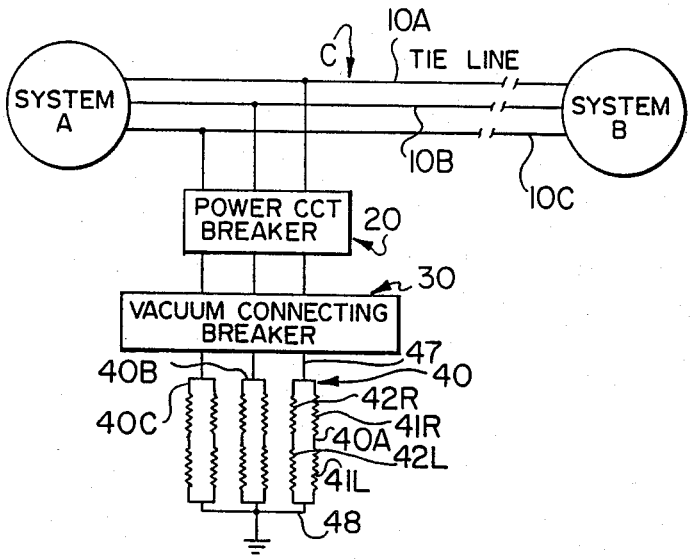
FIG. 1
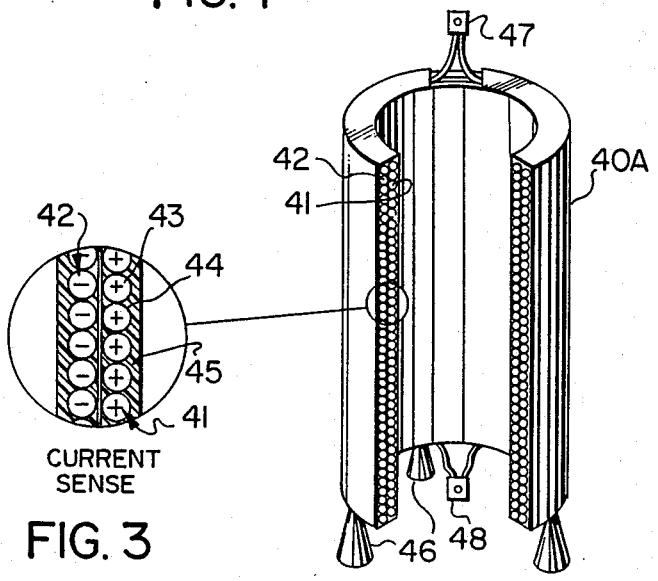
FIG. 3
FIG. 2

HIGH VOLTAGE, OUTDOOR, AIR COOLED, DYNAMIC BRAKING RESISTORS AND POWER DISTRIBUTION SYSTEM INCORPORATING THE SAME

FIELD OF INVENTION

This invention relates to the design and construction of dynamic braking resistors for use in large power systems to ensure stability under fault conditions and to large power systems incorporating the same. These resistors are characterized by having to absorb extremely large energies in a very short time interval. However, they are called upon to do this only very infrequently.

BACKGROUND OF INVENTION

For economic reasons, almost all large electric utilities are interconnected with other utilities through tie lines. This arrangement allows the interconnected utilities to take advantage of the time difference at which peak loads occur in several systems and to decrease the amount of spinning reserve they must have in order to ensure a continuous supply of electricity for their customers even when they experience a serious loss of generating capacity. Thus, the large power grids in all developed nations in the world are characterized by very large power generation canters interconnected by tie lines to other generation and load canters. The amount of steady state power that can be transferred over a tie line is determined to a large extent by the requirement to maintain stability under fault conditions. When a fault occurs in or near a large power center, the generation in the center tends to accelerate and if the resulting angular swing between the faulted center and other canters is large enough, some tie lines may have to be disconnected.

One method of increasing the stability of the system or, what is equally important, of increasing the allowable power transfer along the tie line, is to use dynamic braking resistors to inhibit the acceleration of the generating system under fault conditions. Braking resistors consist of large three phase resistor banks which are connected as loads to the power system when measurements indicate that tie line synchronization may be lost. The resistor bank is injected into the system for a very short time only (typically about one second) and then is automatically disconnected again. The resistor bank has a very short time rating but in the period of approximately one second is able to absorb megajoules or even gigajoules of energy thus limiting the acceleration of the generating capacity in the system and thereby preventing loss of synchronization.

Dynamic braking resistors have been installed in a number of places around the world and have proven their worth. The biggest factor inhibiting their much broader use is the cost of the resistor installations. The resistors described in this disclosure will reduce the cost of installations considerably.

Prior Art

Dynamic braking resistor installations known to applicant are of three types:

(1) Open type cable installations. A good example of this type of installation is that installed by the Bonneville Power Administration near Grand Coulee Dam in the United States. Each phase of this installation comprises 14,700 feet of ½-inch stainless steel wire zigzagged around a transmission tower in 60 ft. vertical loops. The builders of this system claimed it was considerably cheaper than a system comprising cast iron resistors in oil tanks. However, the system was far from inexpensive since each phase necessitated a transmission tower, a large amount of hardware and required a ground space of about 2500 sq. ft. per phase. In addition, many problems have been encountered over the years due to the open structure and the large numbers of the interconnections made between the stainless steel wires.

(2) Air cooled resistors installed in enclosures. The biggest problem with these installations is their large size, since the only insulation is air. For this reason, their use has been limited to systems below about 250 KV voltages. The fact that they have to be enclosed also means that the cost is not small.

(3) Oil immersed resistors.

Resistors for high voltage applications are normally mounted in large oil filled steel tanks. The resistor wires themselves are insulated by the oil in the tank and the leads are connected to high voltage bushings in order to insulate them from the tank. In order to grade the voltage along the overall length of the resistor, it is common to wind the resistor so as to consist of a series connection of antiparallel filaments. These filaments are normally supported in position by clamping them or by weaving them into a fabric made from fibreglass or asbestos. By winding the resistor in this way, the voltage is graded between the parallel filaments and also the overall inductance is small because the current in adjacent filaments is oppositely directed and the overall external magnetic field is very small.

The chief problem with these resistors is their high cost. Besides the resistors themselves and the supporting structure, a transformer type oil tank must be provided with bushings and with oil. Because the insulating material is oil, regular maintenance is required on these units.

SUMMARY OF THE INVENTION

A principle object of the present invention is to provide an improved dynamic braking resistor and power transmission system incorporating the same.

LIST OF DRAWINGS

The invention is illustrated by way of example in the accompanying drawings wherein:

FIG. 1 is a schematic of a portion of a power transmission system having braking resistors of the present invention incorporated therein;

FIG. 2 is an oblique, partial sectional view of a braking resistor of the present invention; and FIG. 3 is an enlargement of the encircled portion of the resistor in FIG. 1.

DESCRIPTION OF THE PREFERRED EMBODIMENT

Illustrated schematically in FIG. 1 is a power system A of one utility company connected to a power system B of another utility company by a tie line C. The tie line C is for a three phase system and includes lines 10A, 10B and 10C. These lines are each connected to a first power breaker system 20 through to a second vacuum connecting breaker system 30 and then to the braking resistors 40. There are three such resistors, i.e. one for each phase, these being designated 40A, 40B and 40C in FIG.

1. The resistors are connected in "Y" at one end and typically grounded at that end as illustrated.

FIG. 2 shows the resistor 40A and is the simplest embodiment of resistor used in the invention. The resistor 40A consists of two oppositely wound helices 41, 42 which are closely coupled, i.e. the space between them is very small. The wire 43 of the respective helices is a metal such as copper, aluminum, stainless steel, nickel-chrome, mild steel, etc. and the wire is insulated as indicated by reference 44 either with an enamel-type coating or a wound-on filament type insulation. The helical windings are encapsulated in a resin i.e. epoxy) glass fiber combination 45 to provide a rigid resistor unit. The rigid unit rests upon insulators 46 which need have only a small BIL (Basic Insulation Level) requirement since such end is normally connected to ground. The resistor 40A has an upper terminal 47 connected to line 10A and a lower terminal 48. Terminals 18 of resistors 40A, 40B and 40C are connected in "Y" and normally connected to ground and terminals 47 of resistors 40B and 40C are connected to respective lines 10B and 10C.

The arrangement of two oppositely wound helices is not bifiler, since the filaments which carry oppositely directly currents are not parallel but spiral in opposite directions and, therefore, have an acute angle between them. The arrangement may be called biplaner, since the overall current sheet comprising the inner layer is antiparallel to the current sheet comprising the outer layer. If the number of turns in the two layers is identical and the pitch in the two layers is the same, then the total ampere turns for each layer is the same and the total ampere turns for the two parallel helices is zero. The only magnetic field produced by this arrangement is that between the two layers and inside the conductors themselves and, therefore, the total inductance for this arrangement is very small.

The voltage drop between adjacent turns of the helix is that produced by the IR drop along the conductor and since the turns are uniformly spaced, then the voltage along the resistor is uniformly graded along the length of the helix. Furthermore, since both layers have exactly the same number of turns there is virtually no voltage between the layers at any point. Furthermore, the capacitance of the coil is uniformly graded along the length of the coil because of the arrangement of turns. Therefore, since the inductance of the system is very low, the overall voltage grading even under impulse is virtually linear since it is determined by the resistance grading and capacitance grading of the windings.

Obviously, any number of pairs of antiparallel wound helices may be used in order to increase the overall current carrying capacity of the system. It is necessary to use an even number of antiparallel layers in order to make the overall inductance of the system virtually zero.

Since the resistor is made only for intermittent use, the choice of the material to be used for the resistor wires and its cross section are determined by the joule energy that must be stored and by the allowable maximum temperature of the insulation materials used and that of the encapsulation which is used for the resistor.

The resistor is encapsulated in fiberglass and epoxy of sufficient thickness to make the overall structure very strong and rigid and make it weather-proof. Because the resistor is used only intermittently, there is ample time between successive usages for the stored energy to diffuse through the body of the resistor and to be removed by natural convection. It is, therefore, unnecessary to have or allow for cooling ducts in the structure regardless of the number of paralleled helices which are used.

In designing the resistor, the height of the resulting resistor is determined by the system voltage across which the dynamic braking resistor is to be connected. Typically, the coils might have a 12 foot height for a 315KV system and a 6 foot diameter. A 735KV system would have a resistor height of 24 feet total which might consist of two or more resistor rigid coils stacked vertically one upon the other. Since the voltage is applied for very short time (a few seconds) and since it is only applied very infrequently, the allowable voltage stress along the external surface of the encapsulated resistor may be very much higher than could be tolerated if the resistor were to be used continuously.

Applicant's resistors for power distribution systems have the following advantages:

(1) The resistors have very low inductance. At 6O hertz the quality Q of the resistors is normally less than 1/100.

(2) Because of the type of arrangement of the wires, the voltage is virtually perfectly graded along the entire length of the resistor both in the steady state and under impulse conditions. The present units are thus capable of being used in systems up to 1000 KV contrary to prior air cooled resistors which have to be limited to 250 KV.

(3) The units require no maintenance as is required for oil filled units.

(4) The units are very small in size and occupy very little space in the substation.

(5) Units are very inexpensive, since they do not require steel tanks, bushings, or oil as is required in the oil insulated type of high voltage resistors. Furthermore, materials which could not be used outdoors, such as mild steel, can be used in these resistors because of the complete encapsulation. Such materials are commonly cheaper than the standard resistance-type materials.

FIG. 1 schematically illustrates the respective resistor rigid coil unit 40A, 40B and 40C as consisting of resistances 41R, 42R and inductances 41L and 42L. As previously described with respect to FIG. 2, each coil has an inner helical winding 41 and an outer helical winding 42 and in FIG. 1 the subscripts R and L on reference numerals 41 and 42 represent respectively the resistance and inductance of these respective helical windings. As previously described, the helical windings 41 and 42 are oppositely wound and while the inductance of each winding is extremely high, the overall inductance of the rigid resistance unit is inconsequential because of the coils being closely coupled and because of winding the coils in opposite directions.

The construction of the resistor illustrated in FIG. 2 permits voltage grading in a simple manner by, for example, winding helices 41 and 42 by two windings high in each and connecting such two windings to different ones of oppositely directed arms on a spider at least one end of the resistor unit. Each helical winding can be more than two conductors high, and by 'two conductors' high applicant means two conductors wound simultaneously one on top of the other in the helix. The technology of partial turns and the use of spiders for connecting cylindrical coil windings is disclosed in applicant's issued patents on current limiting reactors.

The resistors of the present invention can be built from most any resistance winding, for example, nickel-chromium steel, aluminum, iron, mild steel. The choice of wire essentially determines the size of the air core rigid resistance unit. The conductors normally would be insulated with a *mylar insulation which allows a temperature rise of approximately 120° C. An insulation known in the trade as *Kapton may be used which allows a temperature rise of approximately 300° C.

I claim:

1. In a power distribution system that includes a first system connected to a second system by a tie line and braking resistors located adjacent at least one of the power sources and connected to the tie line through a circuit-breaker, improved braking resistors each comprising a first electrical insulated conductor of selected retentivity helically wound in one direction about a central axis and, a second similar insulated conductor helically wound in an opposite direction about said central axis, said first and second helical windings being in a close couple relation with one helical winding overlying the other.

2. The improvement as defined in claim 1 wherein said helical windings are cylindrical.

3. The improvement as defined in claim 1 wherein said helical windings are encapsulated in a rigid plastics material.

4. A high voltage braking resistor for use in a power distribution system comprising at least one pair of first and second cylindrical helical windings of electrical insulated conductor having selected retentivity, said windings being concentric and disposed in a close couple relation with one helical winding overlying the other, said first and second windings of the respective pairs being wound in opposite directions about said axis, means connecting said helical windings in parallel including terminal means for connecting said resistor to a circuit to provide a resistance in such circuit.

5. A resistor as defined in claim 4 wherein said first and second helical windings are encapsulated in an insulating material.

6. A resistor as defined in claim 5 wherein said encapsulating material is a rigid plastics material.

7. A high voltage braking resistor comprising an open ended rigid cylindrical structure, said cylindrical structure have one or more pairs of first and second helical windings whose winding axis is common to the axis of the cylindrical structure and wherein the winding direction of said first and second windings is opposite one another, said windings overlying one another in close couple relation and each comprising an insulated conductor of selected retentivity, and terminal means connecting said windings in parallel and providing connection means to place the resistor in a circuit.

* * * * *

UNITED STATES PATENT AND TRADEMARK OFFICE

CERTIFICATE OF CORRECTION

PATENT NO. : 4,916,428

DATED : April 10, 1990

INVENTOR(S) : Patrick E. Burke

It is certified that error appears in the above-identified patent and that said Letters Patent is hereby corrected as shown below:

Title page, Assignee should read--Guthrie Canadian Investments Limited--

Signed and Sealed this

Seventh Day of January, 1992

*Attest:*

HARRY F. MANBECK, JR.

*Attesting Officer*

*Commissioner of Patents and Trademarks*